US005920635A

United States Patent [19]

Lenz

[11] Patent Number: 5,920,635

[45] Date of Patent: Jul. 6, 1999

[54] HEARING AID

[76] Inventor: Peter Joakim Lenz, Räng, S-235 91, Vellinge, Sweden

[21] Appl. No.: 08/776,241

[22] PCT Filed: Jul. 5, 1995

[86] PCT No.: PCT/SE95/00827

§ 371 Date: Jan. 24, 1997

§ 102(e) Date: Jan. 24, 1997

[87] PCT Pub. No.: WO96/04765

PCT Pub. Date: Feb. 15, 1996

[30] Foreign Application Priority Data

Aug. 4, 1994 [SE] Sweden ..... 9402631

[51] Int. Cl.[6] ..... H04R 25/00

[52] U.S. Cl. ..... 381/328; 381/322; 381/324

[58] Field of Search ..... 381/60, 68, 68.2, 381/68.3, 68.4, 68.6, 69, 69.2, 68.7, 313, 322, 324, 326, 327, 328; 181/129, 130, 135

[56] References Cited

U.S. PATENT DOCUMENTS

| | | | |
|---|---|---|---|
| 2,971,065 | 2/1961 | Busse | 381/68.4 |
| 3,414,685 | 12/1968 | Geib et al. | 381/322 |
| 3,983,336 | 9/1976 | Malek et al. . | |
| 4,069,400 | 1/1978 | Johanson et al. . | |
| 4,471,490 | 9/1984 | Bellafiore . | |
| 4,739,512 | 4/1988 | Hartl et al. | 381/68.6 |
| 4,811,402 | 3/1989 | Ward . | |
| 4,969,534 | 11/1990 | Kolpe et al. | 381/69 |
| 4,974,606 | 12/1990 | Van Mierlo | 128/864 |
| 4,987,597 | 1/1991 | Haertl | 381/69 |
| 5,068,902 | 11/1991 | Ward | 381/68.6 |
| 5,390,254 | 2/1995 | Adelman | 381/328 |
| 5,530,763 | 6/1996 | Aebi et al. | 381/69 |

FOREIGN PATENT DOCUMENTS

| | | |
|---|---|---|
| 0 169 990 | 2/1986 | European Pat. Off. . |
| 0 333 298 | 9/1989 | European Pat. Off. . |
| 0 354 698 | 2/1990 | European Pat. Off. . |

*Primary Examiner*—Huyen Le
*Attorney, Agent, or Firm*—Burns, Doane, Swecker & Mathis, L.L.P.

[57] ABSTRACT

A hearing aid of conventional configuration comprising a microphone at one end adapted to be placed in the inlet of the external auditory meatus, a loudspeaker at the other end adapted to be placed within the auditory meatus, and an amplifying device between the microphone and the loudspeaker, has a means (26) of sound-dampening materials over the microphone to prevent that sound directly impinges upon the latter, but is provided with a passage (27) containing a sound-transmitting medium and directed towards the inner side of one of the parts of the auricle (10), preferably the tragus (14), so that only sound picked up and treated by the auricle (10) is supplied to the loudspeaker.

5 Claims, 1 Drawing Sheet

HEARING AID

This invention relates to a hearing aid, in this instance a body adapted to be placed in the external auditory meatus of the ear with its outer end located approximately in the transition between the auditory meatus and the tragus, with its inner end lying within the auditory meatus and with its central part extending between the outer end and the inner end, a microphone in the outer end, a loudspeaker in the inner end, and an amplifier with current supply located between the microphone and the loudspeaker in the central part of the body or, alternatively, a coupling device to an amplifier with current supply situated outside the hearing aid body, as well as requisite, electrically conductive connections.

Impaired hearing constitutes an increasing problem, which is actually surprising, considering the general requirement nowadays that anyone who frequents premises where sound levels are high should wear hearing protectors. Individuals, however, sometimes disregard this requirement. Recently, researchers have established that also those frequenting premises with reasonably high, but continuous sound levels, such as preparatory schools and the lower and middle departments of comprehensive schools, run the risk of impairing their hearing. Most exposed to this risk perhaps are those attending discotheques as well as the members of pop groups who sometimes—oddly enough—wear hearing protectors. A large group, of course, are those whose hearing is impaired for age reasons.

As means of assistance at impaired hearing, devices have been developed—from the ear trumpets of the last century to today's sophisticated, electronic plugs which are placed in the external auditory meatus. These old and new devices, however, have in common that they directly pick up the sound and, after amplification, transmit it to the interior of the externat auditory meatus, towards the tympanic membrane. This involves a number of problems well-known to the users of hearing aids.

When a person equipped with a hearing aid for instance attends a dinner together with several other persons around the dinner table, the incoming sound will provide a noise carpet made up of a plurality of voices impossible to localise, the clatter of knives, forks and spoons against china, foot movements, etc. Another well-known problem is that sudden, loud sounds in the vicinity of the device, which are directly picked up and amplified, may give rise to considerable pain. When the microphone and loudspeaker of the hearing aid are spaced a minor distance apart, of frequent occurrence in modern hearing aids, feedback howls will arise when the amplification of the device is raised above a definite, relatively low threshold. This constitutes a further problem as it may imply that the amplification because of the feedback risk cannot be set at such a level that the impairment is corrected.

As examples of hearing aids adapted to be placed in the cavum conchae and external auditory meatus, reference is made to U.S. Pat. No. 4 069 400 which shows an entry member with an outwardly facing microphone aperture 14, and to U.S. Pat. No. 3 983 336, where the sound entry aperture 15 is pointed forward. Moreover, hearing aids have been presented, which have forwardly pointing microphones located in spectacle frames. All of these devices directly pick up the sound and thus suffer from the above-mentioned drawbacks.

Hearing aids of the type shown in the above-mentioned U.S. patent specifications nowadays are of considerably smaller dimensions and comprise a plug-shaped plastic shell accommodating microphone, loudspeaker, amplifier, filters, possible a microcomputer and current supply. The dimensions of the plug are of size 14×12 mm. The microphone at the outwardly facing end of the plug is located adjacent the outwardly facing opening of the auditory meatus and is pointed outwardly. It is then struck not only by direct sound but also by sound treated by the auricle, which in reason would muddle the resulting sound picture. In the following specification and claims the term "direct sound" signifies is not only sound emanating directly from the source of sound but also sound reflected from objects in the immediate vicinity of the hearing aid, such as ceiling, floor, furniture etc., i.e. any sound that has not been treated by the auricle.

A modern hearing aid of the above kind is expensive and in certain cases difficult to handle by reason of its tiny controls in case it is not remotely controlled, a feature that makes it still more expensive.

These drawbacks entail that many of those who really ought to wear hearing aids, desist from doing so, choosing instead to try and put up with the social and other problems that an impaired hearing implies.

The invention is based upon the assumption that the auricle (auricula) highly contributes to sound perception. However, it has proved difficult to procure any reports on research made regarding the auricle (auricula)—as far as I have been able to find, it has merely been established that the auricle has a direction-determining function and that it probably also functions as a kind of filter and variably delays sound transmission paths. Conducive to the researchers being uninterested in the auricle, perhaps is also the fact that its appearance changes in detail from one individual to another. It should, however, be borne in mind that nature does not do anything without due cause, so each auricle detail has its own function, and that the specific shape of the auricle of an individual perhaps is nature's adaptation thereof to the prerequisites of the individual having the auricle.

One object of the present intention is to eliminate or anyway to reduce to the greatest possible extent the present drawbacks of hearing aids, while exploiting the auricle.

Another object of the invention is to so exploit the auricle that certain sound treating parts of the conventional hearing aid may be eliminated or anyway considerably simplified so that the costs of production of the hearing aid are reduced, perhaps to such an extent that it is possible to manufacture an expendable hearing aid.

These objects are achieved in that the microphone at the outer end is covered with sound-dampening material to prevent that direct sound coming from outside reaches and actuates the microphone, but has at least one entry passage which contains a sound or vibration transmitting medium and whose inlet, which faces away from the microphone, is directed towards the inner side, i.e. the side facing the external auditory meatus, of at least one of the parts of the auricle.

In a preferred embodiment of the invention, the microphone with the exception of the entry passage is entirely enclosed in an envelope of sound-dampening material. The entry passage advantageously is pointed to the inner side of the tragus and preferably spaced some distance therefrom.

The invention will be described more in detail hereinbelow with reference to the accompanying drawing which very diagrammatically shows some embodiments chosen by way of example.

Figure 1:
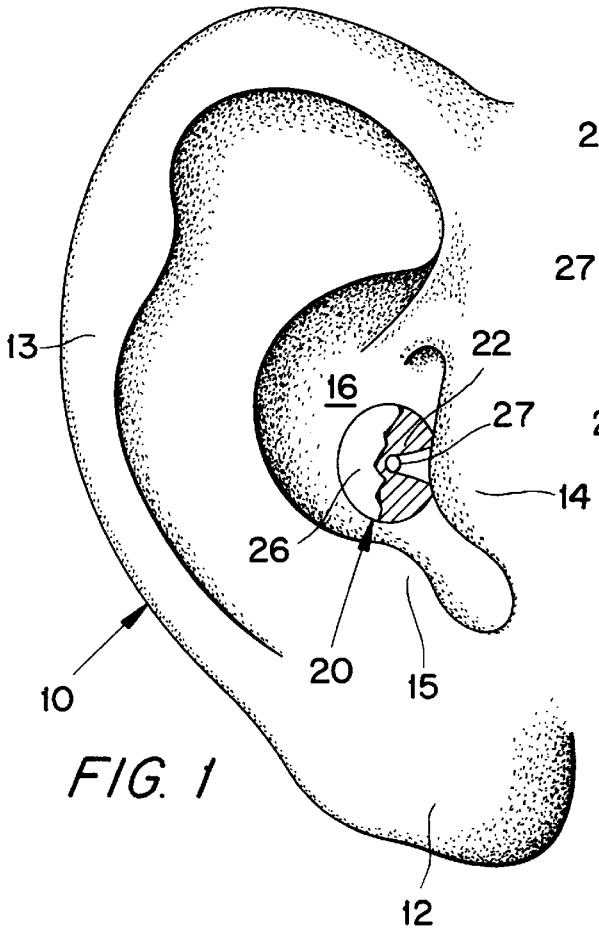
FIG. 1 shows a right ear from the outer side with a hearing aid according to the invention inserted therein, the outer end of the hearing aid having been partly cut to illutrate the entry passage thereof.
Figure 2:
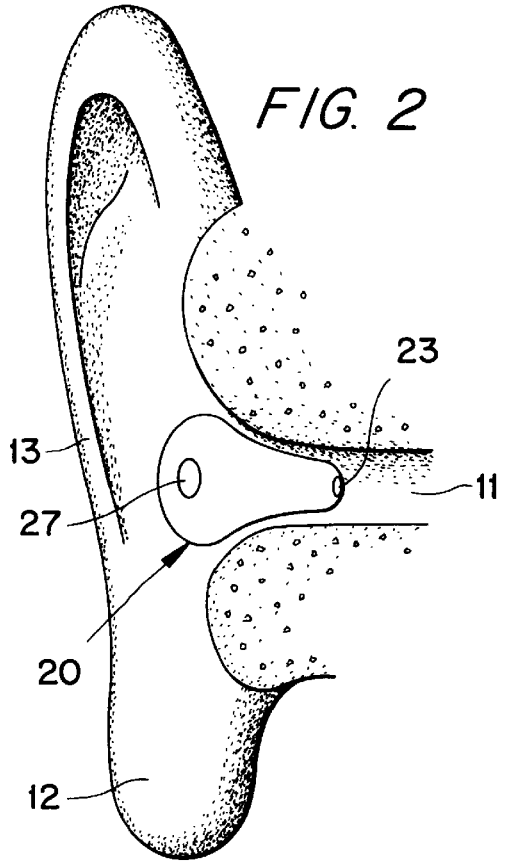
FIG. 2 shows the right ear of FIG. 1 from the front, the cut being located behind the tragus to illustrate the position of the hearing aid according to the invention.

According to FIGS. 1 and 2, the auris externa. i.e. the external ear, comprises the auricula (auricle) 10 and the meatus acusticus externus (the external auditory meatus) 11. The auricle 10 has a plurality of parts, of which mention will be made of the most important parts only, viz. the helix 13 which is the incurved rim of the auricle, the lobus auriculae (the ear lobe) 12, the tragus 14, the antitragus 15, and the concha auriculae (the cavity of the auricle) 16. The fact that the remaining parts are not enumerated, does not signify that they are without importance to the intention.

Figure 3:
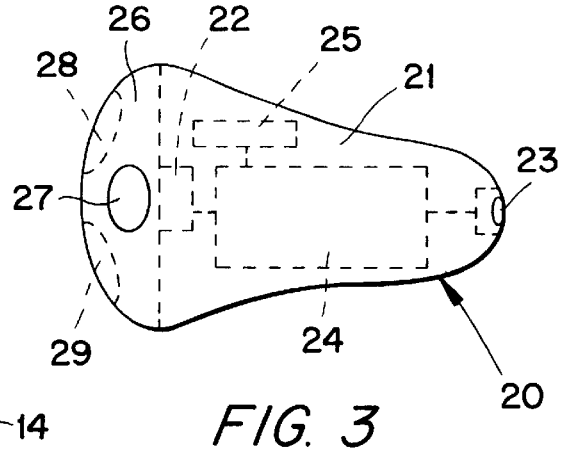
FIG. 3 shows the hearing aid according to the invention from the side and on a larger scale.

The invention, as it is shown in FIGS. 1–3, is based on a hearing aid, available on the market and well-known to those skilled in the art, which comprises a body 21 adapted to be inserted in the external auditory meatus 11 in the way shown in FIG. 2, with its outer end located in the cavity 16 of the auricle behind the tragus 14 and outside the inlet opening of the external auditory meatus 11, and with its inner end lying within the external auditory meatus 11, i.e. facing the tympanic membrane not shown. Said outer end has an acousto-electric transducer or microphone 22 and said inner end has an electro-acoustic transducer or loudspeaker 23. In the part extending between the outer end and the inner end, the body 21 has an amplifier 24 with current supply 25 (battery) coupled to the microphone 22 and the loudspeaker 23.

In the following use is made, in the specification and claims, of the words microphone and loudspeaker instead of the terms acousto-electric and electro-acoustic transducers which are somewhat more difficult to handle from a linguistic point of view. However, the former shall be considered quite as extensive as the latter and shall not be considered limited to microphones and loudspeakers of the design and function known today.

In hearing aids of recent times the amplifier also comprises filters and/or a microcomputer. Although the idea of the invention is to substitute nature's own corresponding organs (the auricle) for the filters and microcomputer there may be required in certain specific cases a special signal treatment, for which reason the word "amplifier" in the present specification and claims implies an amplifier having such signal treating means as produce, in cooperation with the auricle, the best possible sound that is perceivable by the internal ear.

In the outer end the body 21 may also have operating means for connecting and disconnecting the current supply 25 and for the control of the amplification. For greater simplicity of the drawing, these operating means have not been illustrated. The function of these means may of course also be realised by remote control in a manner well-known in the field of electronics, e.g. by means of infra light or radio waves. The lid of the battery space is not either shown.

Thus, the hearing aid consisting of parts 21–25 is prior art and, like the device according to the above-mentioned U.S. Pat. No. 4 069 400, it has an outwardly pointing inlet opening, leading to the microphone 22, in the wall delimiting the outer end of the device. Said wall is indicated by a broken line in FIG. 3.

A hearing aid 20 according to the invention can be obtained by providing for instance the above-described prior-art hearing aid with a "cover" 26 of sound-dampening material over the inlet opening of the microphone 22 so that no direct sound strikes the microphone 22. The housing of existent hearing aids 20 being normally manufactured of relatively thin plastic material, the cover 26 should preferably extend over the entire outwardly facing side of the hearing aid, as indicated in FIG. 1 and perhaps even extend some distance over the rim of the part of the device containing the amplifier, although this is not illustrated in the drawing, in order to prevent direct sound from leaking in. However, said cover 26 has a passage 27 for transmitting sound waves picked up and treated by the auricle 10 to the microphone 22. According to FIG. 1, said entry passage 27 is directed towards the inwardly facing side of the tragus 14, i.e. the side facing the external auditory meatus. In simple tests, the inner side of the tragus 14 has proved to function well in this connection, but there is nothing to prevent other parts also of the auricle 10 from functioning satisfactorily, for example the antitragus 15. It is also possible to arrange more than one entry passage 27, e.g. one that is directed towards the tragus 14 and another that is directed towards the antitragus 15.

The simplest embodiment of the passage 27 is an air passage whose end, that faces away from the microphone 22, is spaced a minor distance from the inner side, i.e. the side facing the inlet opening of the external auditory meatus 11, of e.g. the tragus 14. If necessary, the entry passage 27 may be adjusted, i.e. its shape, cross-sectional dimension and length adapted to each other, so that the best possible vibration pick-up is obtained from the part concerned of the auricle. If there are two passages 27 and they are directed towards for instance the tragus 14 and the antitragus 15 or some other part of the auricle 10 it might be necessary to adapt them in relation to each other. The passage or passages 27 may for instance have a shape, well-known in acoustics, that tapers exponentially towards the microphone 22. The cover 26 shall have such dimensions as not to impede the normal sound conveyance between the parts of the external ear to any appreciable extent.

The sound-dampening material may consist of any material, well-known to those skilled in acoustics and appropriate for the purpose, that possesses the desired sound-dampening property and also the requisite strength for the manipulation of the hearing aid. Several materials have been tested, from metals to semi-rigid plastic compositions, and of these the latter seem to be preferable. The cover 26 may of course also consist of several layers of material, e.g. an exterior rigid plastic material and an interior softer material.

To facilitate the insertion of the hearing aid 20 in the external auditory meatus 11 the cover 26 of sound-dampening material may have some configuration that facilitates placing the hearing aid 20 in the external auditory meatus 11, e.g. two recesses 28, 29 for the tips of the index finger and thumb, as indicated by broken lines in FIG. 3. For access to the interior of the hearing aid, e.g. exchange of battery, the cover 26 may be pivoted or screwed to the hearing aid device 20.

Figure 4:
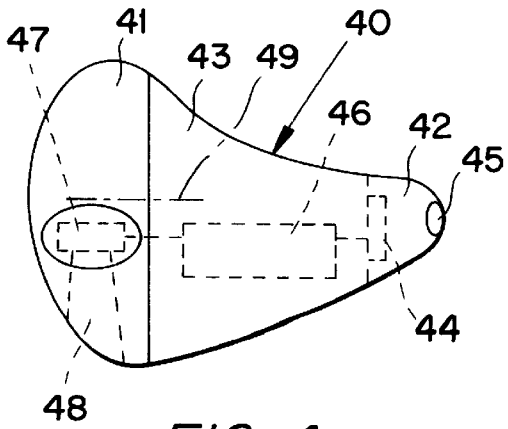
FIG. 4 shows a modified hearing aid according to the invention, as seen from above.

FIG. 4 schematically shows the embodiment of a hearing aid which I believe will be that of the future. The hearing aid 40 comprises three parts, viz. an outwardly facing microphone part 41, a loudspeaker part 42 and a central part 43 uniting said parts.

The loudspeaker part 42 may be a separate part connected with the central part 43 or, as shown, be integral with the. central part 43. The loudspeaker part 42 has a loudspeaker chamber with a loudspeaker 44 mounted therein and presents an outlet opening 45 normally covered with a wax filter (not shown). For reduction of feedback to the microphone in part 41, the loudspeaker part 42 may be elastically or yieldingly connected with the central part 43.

The central part 43 contains an amplifier 46 driven by a battery, and the requisite leads to the microphone part 41 and the loudspeaker part 42. The central part 43 suitably has an outwardly open passage (not shown) extending to the amplifier 46, and through said passage e.g. a screwdriver may be inserted for actuation of an amplification control means arranged on the amplifier. The battery may be disposed in the central part 43, but it would be more suitable to dispose it in the microphone part 41. The battery has not been shown to avoid making the figure more complicated. Instead of the amplifier 46 a connection may be arranged for a cable leading to a separate amplifier, carried for instance in the pocket. The central part 43 may consist of a plastic shell of suitable shape, but it may also be in the form of a solid body of elastic plastic or cellulosic material or be formed by a wire wound into a conical, curved spiral which is preferably slightly yielding in the transverse direction. If the central part 43 is of harder plastic material it may present a peripheral coating of sound-dampening elastic material that prevents sound propagation outwardly.

The microphone part 41 is a separate body of solid sound-dampening material, e.g. plastic or cellulosic material in which a microphone 47 is arranged. The input side of the microphone 47 communicates with the outer side of the body merely through a passage 48 which, like the passage 27 described above, is directed towards an inwardly facing part of the auricle, preferably the inner side of the tragus 14. All other sides of the microphone are enclosed by the sound-dampening material of the microphone part, thus also the inwardly turned side facing the central part 43. The microphone 47 may be cast into the sound-dampening material or glued in the inner end of the passage 48. The microphone 47 may also be fixed in an envelope of elastic or yielding material, said envelope being in turn disposed in the microphone part 41 and having an opening interconnecting the passage 48 with the microphone 47.

The microphone part 41 may also present a recess in which the current supplying battery is placed. The side of the microphone part 41 turned towards the central part 43 is conformed to the outwardly facing side of the central part and both of said sides are provided with the requisite contacts (not shown) which serve to connect the microphone 47 and the battery with the amplifier 46. The microphone part 41 is preferably connected with the central part 43 by means of an eccentrically arranged shaft extending in the longitudinal direction of the hearing aid 40. Said shaft is indicated in FIG. 4 by means of a dash and dot line 49. In the activated position shown in FIG. 4, the contacts of the microphone part 41 are engaged with those of the central part 43, while said contacts, when the microphone part 41 is turned out of position, are disengaged and the hearing aid is in inactuated position. With such an activating mechanism also elderly people with relatively insensitive fingers are able to operate the hearing aid. The microphone part 41 as well as the central part 43 may also be so designed that large operating means permit being connected therewith, in a readily detachable manner, for activation and inactivation of the hearing aid 40 by said group of elderly people. This possibility is not illustrated as it may be realised in many ways. The microphone part 41 is preferably connected with the central part 43 by a snap locking device so that it can be released by being pulled away from the central part 43 longitudinally thereof and again connected by being moved in the opposite direction. In this way the microphone part can readily be exchanged. Moreover, the microphone part 41 may be connected with the central part 43 by means of elastic connecting means in order to further isolate the part 41 from vibrations in the central part 43 and the wall of the auditory meatus 11, and besides the loudspeaker part 42 may be elastically connected with the central part 43.

A microphone part 41 that is designed in the manner outlined above involves many advantages. The arrangement of the microphone 47 in the manner described so that only sound treated by the auricle reaches the microphone 47, eliminates or at least minimizes any disturbing direct sound. Filters and microcomputers can normally be dispensed with. Loud sound that results in pain is reduced in the same way as at normal hearing and, finally, feedback between loudspeaker and microphone is reduced. The microphone part 41 is readily exchangeable.

As pointed out above, the entry passage 27 and 48, respectively, in the simplest embodiment is filled with air, i.e. communicates with the atmosphere and then is preferably spaced a distance from e.g. the inner side of the tragus, but it is also conceivable to fill said passage with some other sound-transmitting material, the outer end of which is adjacent or bears against the inner side of e.g. the tragus 14, while the inner end of said material in a suitable magnetic, in the field of electronics well-known electric or mechanical manner via the amplifier transmits the picked-up vibrations to the loudspeaker 23. Such a sound-transmitting material may be solid or a liquid or gaseous medium enclosed between an outer and an inner membrane, said outer membrane sensing the vibrations of e.g. the tragus 14 and said inner membrane actuating the microphone via suitable means. Instead of one passage according to FIGS. 3 and 4, a plurality of parallel passages of smaller cross-section, each containing a vibration-transmitting material, may be arranged between the outer side of the cover 26, and the microphone 22. According to FIGS. 1 and 4, the passages 27 and 48 are of considerable length in order to protect the microphone 22 and 47, respectively, against direct sound. This length may be reduced considerably as long as it can be guaranteed that the microphone cannot be reached by sound that has not been treated by the auricle 10. f necessary, the passages 27, 48 may also be lengthened for reduction of feedback between loudspeaker 23, 44 and microphone 22, 47.

A number of measurements have been carried out to check the tenability of the inventive idea. In a living room size 8×8 m, use was made of a source of sound in form of a stereo unit of reference class, on which a compact disc with 20 frequency bands 20 Hz–20 kHz and bands of white noise and pink noise was played. A conventional all-in-the-ear type of hearing aid was emptied of its normal contents and a high-class microphone from Pearl Mikrofonlaboratorium AB, Astorpt Sweden, Model No. ET-5000S and dimension 0 5 mm×2.7 mm was fixed to the hearing aid so that, after insertion of the hearing aid in the external auditory meatus, said microphone was located at the place where the hearing aid microphone in prior-art hearing aids is disposed, i.e. in the concha auriculae adjacent the mouth of the external auditory meatus, and was connected with a measuring amplifier equipped with instruments graduated in dB. Two series of measurements were made, viz. series A with the microphone in open arrangement so that it picked up both direct sound and sound treated by the auricle, and series B where the microphone was enclosed in a sound-dampening material with the exception of a passage directed towards the inner side of the tragus (approximately as in FIG. 1), whereby only sound treated by the auricle reached the microphone.

No account is given herein of the measurements or the curves drawn up on the basis thereof since the recordings were not made in the laboratory and cannot therefore be considered as strictly scientific. The measurements were primarily made in order to establish a tendency. This tendency, however, is decidedly unambiguous as it appeared, surprisingly enough, that higher measured values were obtained when the microphone was exposed only to sound treated by the auricle except at the lowest frequencies (below 125 Hz) and the highest frequencies (over 12 kHz). One might have imagined that the entirely open microphone (A) would deliver higher values, but that was not the case.

In a special test the subject of the experiment was placed in such a way that the ear carrying the hearing aid with the special microphone as defined above was pointed directly towards the source of sound (0°), then turned through an angle of 90° from the source of sound, after that through 180° and finally through 270°. White noise and pink noise was then transmitted from the source of sound. With the hearing aid and the microphone, respectively, pointing straight away from the source of sound (180°), the measured values were the same, but at all other angles there were obtained, with the microphone arranged according to the invention, 2–5 dB higher measured values.

The above measurements do not per se confirm the fulfilment of the objects of this invention, but it clearly appears from the measurements that the auricle has an amplifying function in this connection which-as far as I understand-has been properly utilised for the first time in the present invention for the realisation of a well-functioning hearing aid.

The above measurements evidence that a microphone which only picks up sound treated by the auricle, supplies a stronger signal in the important sound range than a microphone which is entirely open outwards. In my opinion, the auricle obviously functions as a filter and makes a microcomputer unnecessary (even if filters and a microcomputer in certain specific cases may be connected with the amplifier though this is not the purpose of the invention). The hearing aid according to the invention then comprises only a microphone, an amplifier with battery, and a loudspeaker as well as cases for them. These parts being inexpensive, particularly in large series, it will therefore be possible to manufacture a very inexpensive hearing aid 40—in the extreme case an expendable device. In case the hearing aid 40 according to FIG. 4 comprises a readily exchangeable microphone part 41 a hearing aid 40 can be supplied including a plurality of microphone parts 41 which are exchanged when the battery therein is exhausted, or when a person for aesthetical reasons wants a microphone part of another appearance.

The invention has been described and shown solely for illustration of the inventive idea. Many practical embodiments are possible. The shape of the "cover" 26 and the microphone part, respectively, may be varied within broad limits provided the function of the auricle is not unfavourably influenced, and these parts may, as has been mentioned, be manufactured of a number of different materials, primarily plastic materials or natural or synthetic rubber. The entry passage 27 and 48, respectively, to the microphone is shown in the drawing as being a relatively narrow, outwardly widening passage. In an embodiment (not shown) the passage was formed as a slot along a plane approximately at right angles to the auditory meatus 11, i.e. parallel to the broken line in FIG. 3 adjacent the microphone and the full line in FIG. 4 between the microphone part 41 and the central part 43, respectively. The slot was of a height at right angles to said plane of about 1,5 mm and in one case extended round ¼ of the circumference of the cover 26 and the microphone part 41, respectively, and in another case round almost the entire circumference of these parts. In the first case the inlet opening of the slot was directed towards the inner side of both the tragus 14 and the antitragus 15, and in the second case towards these parts and towards the greater part of the circumference of the concha auriculae 16. The latter embodiment may also be described as a disk-shaped cover disposed parallel to and spaced from the outwardly facing side (broken line in FIG. 3) of the hearing aid and connected with the hearing aid side by means of one or a couple of, preferably thin spacers. Both of the slot embodiments satisfied the purpose of the intention and, surprisingly enough, the tendency of self-oscillation was reduced to a high degree.

Particularly the configuration of the cover 26 and the microphone part 41 and the shape of the entry passage 27 and 48, respectively, may thus be varied to a high degree and must not be considered limited to what is shown in the drawing.

I claim:

1. A hearing aid comprising:

a body adapted to be placed in the external auditory meatus of the ear, with its outer end located approximately in the transition between the auditory meatus and the tragus, with its inner end lying within the auditory meatus, and with a central part extending between the outer end and the inner end, a microphone in the outer end and a loudspeaker in the inner end, and an amplifier with current supply located between said microphone and said loudspeaker in the central part, wherein the microphone in the outer end is covered with a sound-dampening material to substantially prevent direct sound coming from outside from reaching and actuating said microphone, and wherein said material is provided with at least one entry passage which contains a sound or vibration transmitting medium, said at least one entry passage having an inlet which faces away from the microphone and which is directed towards an inner side of the tragus, the inner side facing the external auditory meatus; and wherein the sound or vibration transmitting medium in the entry passage of the microphone is air, and the inlet of said passage is spaced a minor distance from the inner side of the tragus.

2. A hearing aid as claimed in claim 1, wherein the shape, length and cross dimension of the entry passage are adapted to each other in such a way that the reception of sound and vibrations, respectively, from the part concerned of the external ear is maximized.

3. A hearing aid as claimed in claim 1, wherein the microphone part is elastically connected with the central part.

4. A hearing aid as claimed in claim 1, wherein the microphone part is detachably connected with the central part.

5. A hearing aid as claimed in claim 1, wherein the inlet to the at least one entry passage is not facing directly outwards from the external auditory meatus of the ear.

* * * * *